United States Patent [19]

Yates et al.

[11] 4,005,323

[45] Jan. 25, 1977

[54] MICROCHANNEL PLATES IN GLASS MOUNTINGS

[75] Inventors: Colin K. Yates; Eugene C. Jastrzebski, both of Dudley, Mass.

[73] Assignee: American Optical Corporation, Southbridge, Mass.

[22] Filed: Nov. 15, 1971

[21] Appl. No.: 203,098

[52] U.S. Cl. ..... 313/105 CM; 65/4 B; 65/36; 65/43; 250/207

[51] Int. Cl.² ..... H01J 43/04

[58] Field of Search ..... 65/4, 36, 41, 43; 315/12 R; 250/207; 313/103 CM, 105 CM

[56] References Cited

UNITED STATES PATENTS

| | | | |
|---|---|---|---|
| 3,156,950 | 11/1964 | Walton, Jr. | 65/4 X |
| 3,253,896 | 5/1966 | Woodcock et al. | 65/43 |
| 3,275,428 | 9/1966 | Siegmund | 65/4 |
| 3,331,670 | 7/1967 | Cole | 65/4 |
| 3,332,757 | 7/1967 | Hawkins | 65/36 |
| 3,639,113 | 2/1972 | Aslanova et al. | 65/4 |

*Primary Examiner*—Richard D. Lovering
*Attorney, Agent, or Firm*—William C. Nealon

[57] ABSTRACT

A glass electron-multiplying microchannel plate of lead-containing glass is mounted within a supporting rim of another glass. The plate is connected to the rim with a relatively low melting temperature solder glass and the rim is slotted at a number of points about its periphery. The slots extend completely through the rim and partially into the connecting solder glass to protect against fracturing of the assembly during treatment thereof in reducing atmospheres.

5 Claims, 4 Drawing Figures

MICROCHANNEL PLATES IN GLASS MOUNTINGS

BACKGROUND OF THE INVENTION

1. Field of the Invention:

Glass micorchannel plates in glass mountings.

2. Description of the Prior Art

Glass microchannel plates are normally very fragile and difficult to handle during certain stages of their manufacture and also in adapting them to electron multiplying image intensifying devices and the like in which they are intended for use. Accordingly, it has been desirable to mount these plates within solid glass annuli or rims for strengthening thereof.

Heretofore, however, separation of the plates from respective rims commonly occurs during or following activation of the plate glasses within reducing atmospheres which are used for the usual purpose of rendering channels of the lead-containing glass plates electrically semi-conductive. This separation is due primarily to shrinkage of the plate structure as a result of removal of oxygen from its glasses. Activation in reducing atmospheres additionally tends to alter the expansion coefficient of lead-containing glasses with little of different effect upon the usual solid glass rim in each case. The thus created mismatch in expansion coefficients of the channel plate material and its rim tends to cause further fracturing of the assembly.

This invention relates to matters of overcoming undue strain in the aforementioned type of rim-to-plate connections regardless of plate shrinkage during processing and avoidance of fracturing due to occurrences of expansion coefficient mismatching in glass mounted microchannel plates.

SUMMARY OF THE INVENTION

Objectives of the present invention are accomplished by connecting glass annuli or rims to the usual lead-containing glass microchannel plate structures with a thickness of a solder glass in each case. The connecting glass is selected to have a softening temperature sufficiently low to flow and relieve strain tending to be applied to the rim as the plate structure glass is caused to shrink in typical reducing atmospheres. Further, in overcoming the aforementioned problems of changes in relative coefficients of expansion between the glasses of a microchannel plate structure and its supporting rim, a plurality of slots are provided about the edge of the assembly in each case. Each slot is preferably extended completely through rim, partially into the solder glass connection.

Details of this invention will become more readily apparent from the following description when taken in conjunction with the accompanying drawing.

DESCRIPTION OF THE PREFERRED EMBODIMENTS

Figure 1:
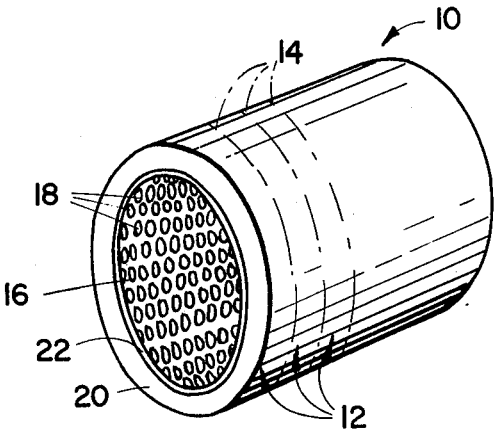
FIG. 1 is an illustration, in perspective, of a sheathed microchannel structure from which glass mounted microchannel plates are formed according to the present invention.

FIG. 1 illustrates an assembly 10 from which microchannel plates 12 may be formed by cutting the assembly transversely along dot-dash lines 14, for example.

Assembly 10 is comprised of a relatively large boule 16 of fused together glass tubules which, as such, form microchannels 18 extending through a matrix of glass.

Exemplary microchannel structures and methods of making the same are shown and described in U.S. Pat. Nos. 3,331,670 and 3,275,428. It should be understood, however, that neither a precise form of multichannel structure for boule 16 nor method of making the same is of particular concern to this invention. The invention relates to matters of mounting most, if not all, well known types of microchannel structures in glass supporting annuli or rims.

Microchannel structures such as boule 16 and plates formed thereof, in particular, are ordinarily very fragile and difficult to handle without breakage. Thus, their mounting in glass rims provides protection against breakage during handling and processing. The glass rims also serve as attachment mounting means for rendering the plates more readily adaptable to image intensifier tube envelopes and the like within which they are commonly used.

According to the present invention, boule 16 is sheathed with a glass tube 20 which is connected to the boule by an intermediate layer of relatively low melting temperature frit or solder glass 22. Plates 12 are then cut from assembly 10 as described hereinabove.

Figure 2:
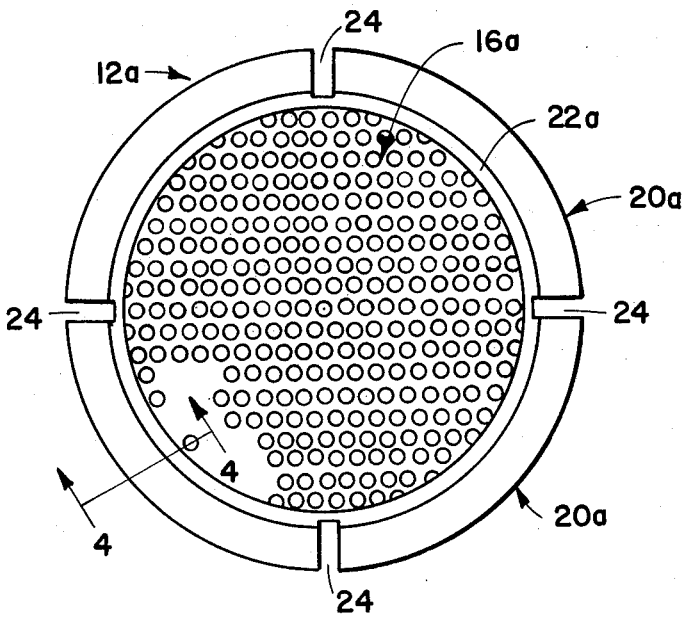
FIG. 2 diagrammatically illustrates a form of treatment commonly given to microchannel plate structures and which is of particular concern to matters of this invention.

One such plate **12*a* is illustrated in FIG. 2 as having multichannel structure 16*a*, glass rim 20*a* and a substantial thickness of interconnecting low temperature solder glass 22*a*. Rim 20*a* of plate 12*a* is additionally provided with a number of slots 24, each of which extends completely through rim 20*a* and preferably, but not necessarily, partially into solder glass 22*a*. Plate 12*a* (FIG. 2) is illustrated as having four such slots each directed radially into the plate. A greater or lesser number of similar slots, preferably equally distantly spaced from each other, may be used. Plate 12*a*** is thus rendered readily adaptable to processing in heated reducing atmospheres without undue fracturing before, during or following the processing.

Figure 4:
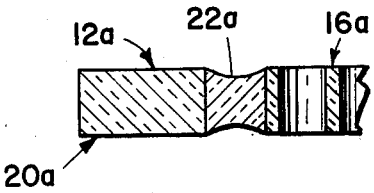
FIG. 4 is an enlarged fragmentary cross-sectional view of the microchannel plate structure shown in FIG. 3.

Rim **20*a* supports and protects the more delicate channel structure 16*a* during handling prior to processing and solder glass 22*a* (FIGS. 2 and 4) becomes sufficiently flowable during processing to release or prevent strain from occurring between rim 20*a* and microchannel structure 16*a*. Solder glass 22*a* stretches as structure 16*a* shrinks (see FIG. 4.). At the same time, while removal of oxygen from channel structure 16*a* in the reducing atmosphere tends to alter its expansion coefficient, slots 24 permit adjustment in circumferential dimension of rim 20*a* in response to expansion and contraction of channel structure 16*a*** and also in response to its own expansion and/or contraction thereby further overcoming prior art fracture problems.

Exemplary glasses useful in the manufacture of channel plates according to this invention are a lead-flint glass containing from approximately 50 to 60% lead as the matrix glass of channel sections **16*a*, a frit or solder glass 22*a* having a softening temperature within a range of from approximately 650° and 700° F and soda-lime or crown glass for rim 20***a*.

Figure 3:
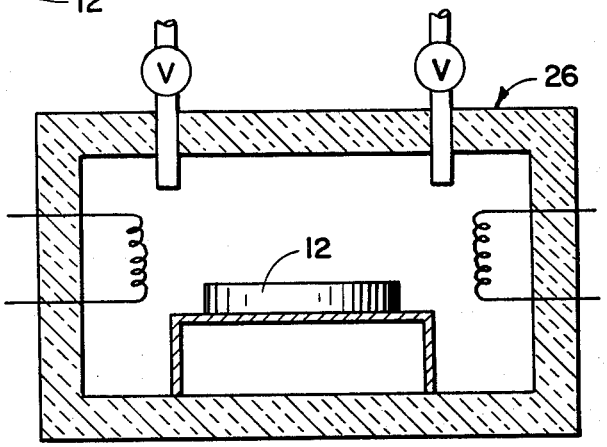
FIG. 3 is a plan view of a preferred embodiment of the present invention.

Processing in reducing atmospheres to render surfaces of the aforementioned exemplary lead-containing glass semi-electrically conductive may be accomplished in a chamber or furnace 26 (FIG. 3). Furnace 26 containing plate 12*a* would thus be filled with hydrogen, for example, at 680° F for approximately 9 hours and raised to 825° F for approximately 5 minutes followed by cooling of plate 12*a* within the same or another oxygen-free atmosphere.

We claim:

1. A glass microchannel plate comprising:

a multichannelled structure of electrically semi-conductive glass;

a rim of glass surrounding said multichannelled structure;

a substantial thickness of solder glass interconnecting said multichannelled structure and said rim; and said rim having at least one slot extending completely therethrough.

2. A glass microchannel plate according to claim 1 wherein said rim has a plurality of slots extending completely therethrough said slots being approximately equally spaced from each other in directions peripherally about said rim.

3. A glass multichannel plate according to claim 1 wherein said slot further extends into said thickness of solder glass.

4. A glass multichannel structure according to claim 2 wherein each of said slots further extend at least partially into said thickness of solder glass.

5. A glass microchannel plate according to claim 1 wherein said multichannelled structure and rim are circular in configuration and said thickness of solder glass extends completely circumferentially about said multichannelled structure.

* * * * *